US011104155B2

(12) United States Patent
Lichtenberg

(10) Patent No.: US 11,104,155 B2
(45) Date of Patent: Aug. 31, 2021

(54) METHOD AND APPARATUS FOR PROTECTING A PRINT HEAD IN A THERMAL PRINTER

(71) Applicant: Hurst International, LLC, Chatsworth, CA (US)

(72) Inventor: Ari Lichtenberg, Chatsworth, CA (US)

(73) Assignee: HURST INTERNATIONAL, LLC, Chatsworth, CA (US)

( * ) Notice: Subject to any disclaimer, the term of this patent is extended or adjusted under 35 U.S.C. 154(b) by 0 days.

(21) Appl. No.: 16/877,960

(22) Filed: May 19, 2020

(65) Prior Publication Data

US 2020/0276830 A1 Sep. 3, 2020

Related U.S. Application Data

(63) Continuation-in-part of application No. 16/393,435, filed on Apr. 24, 2019, now Pat. No. 10,786,999, which is a continuation of application No. 15/839,267, filed on Dec. 12, 2017, now Pat. No. 10,399,358.

(51) Int. Cl.

| | |
|---|---|
| ***B41J 2/34*** | (2006.01) |
| ***B41J 2/335*** | (2006.01) |
| ***B41J 2/32*** | (2006.01) |

(52) U.S. Cl.
CPC ..... *B41J 2/3353* (2013.01); *B41J 2/32* (2013.01); *B41J 2202/30* (2013.01)

(58) Field of Classification Search
None
See application file for complete search history.

(56) References Cited

U.S. PATENT DOCUMENTS 5,574,485 A * 11/1996 Anderson ..... B41J 2/16552 134/1
2003/0090538 A1* 5/2003 Silverbrook ..... B41J 2/175 347/42

* cited by examiner

*Primary Examiner* — Erica S Lin
*Assistant Examiner* — Tracey M McMillion
(74) *Attorney, Agent, or Firm* — Tutunjian & Bitetto, P.C.

(57) ABSTRACT

The method and apparatus for protecting the printhead heating elements in a thermal printer includes preparing the printer for label dispensing and then covering the printhead heating elements such that the label run or thermal material passing over the same does not contact the printhead heating elements. The cover for the printhead heating elements can take various forms. In one implementation, the cover is a sleeve configured to fit over the entire printhead assembly of the thermal printer. In another implementation, the cover is a shim placed between the printhead and a label run path. The printhead cover has a low coefficient of friction.

7 Claims, 7 Drawing Sheets

METHOD AND APPARATUS FOR PROTECTING A PRINT HEAD IN A THERMAL PRINTER

CROSS-REFERENCE TO RELATED APPLICATIONS

This application is a continuation-in-part of U.S. patent application Ser. No. 16/393,435, filed on Apr. 24, 2019, which is a continuation application of U.S. patent application Ser. No. 15/839,267, filed on Dec. 12, 2017, now U.S. Pat. No. 10,399,358.

BACKGROUND

Technical Field

The present invention relates to thermal printers. More particularly, it relates to a method and device for protecting the print elements and its overlaying coating of a thermal print head.

Description of the Prior Art

Thermal printers are used for many different label printing operations. They are also used in some industries as label dispensers as well as printers. The thermal print heads in these printers are subject to wear when printing labels, and also when not printing labels (i.e., when the printer is being used as a label dispenser for already printed labels) and the thermal elements are turned off. In either instance, the abrasive action or friction of the labels or other material traveling against the surface of the overlaying protective coating of the thermal print head will cause damage to the print head. In fact, this abrasive action/friction is the main cause of damage to the thermal print head. Thus, when using the thermal printer as a label dispenser for already printed labels, there is a need to protect the print head from this abrasive action.

SUMMARY OF THE INVENTION

The present inventions address the shortfalls of existing thermal printing machines by providing a protective cover to the thermal print head to prevent head wear when the printer is being used to dispense already printed labels.

According to one implementation, the thermal printer includes a print head assembly having a printhead, and a cover removably disposed over the printhead heating elements and configured to prevent the same from being exposed to a material passing over the same during label dispensing.

According to a further implementation, the printhead cover has a low coefficient of friction and is in the form of a sleeve that fits over the entire printhead assembly.

According to another implementation, the protective cover includes a shim assembly. The shim assembly includes a holder having a mounting device configured to affix the shim assembly to the thermal printer proximate to a printhead assembly, and a shim held by the holder. The shim is dimensioned to extend from a mounting point of the mounting device to a point covering the heating elements of a printhead of the printhead assembly.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1:
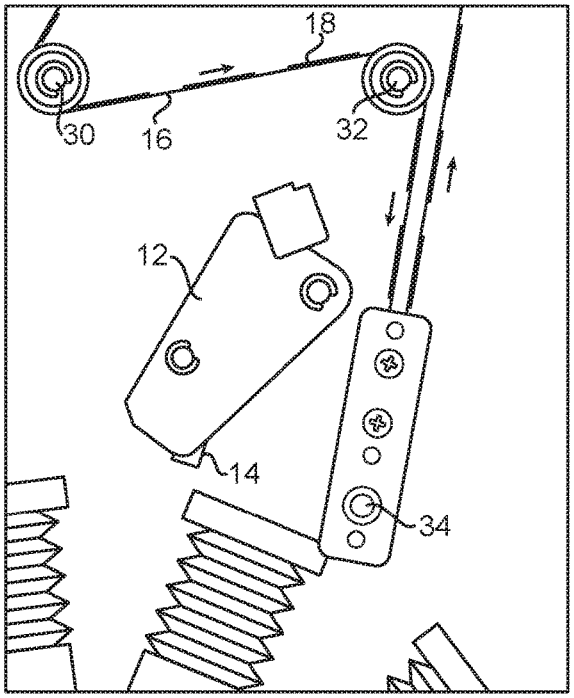
FIG. 1 is a schematic overview of the print head of a thermal printer and label path with the print head positioned away from the label run, according to an embodiment of the invention.
Figure 2:
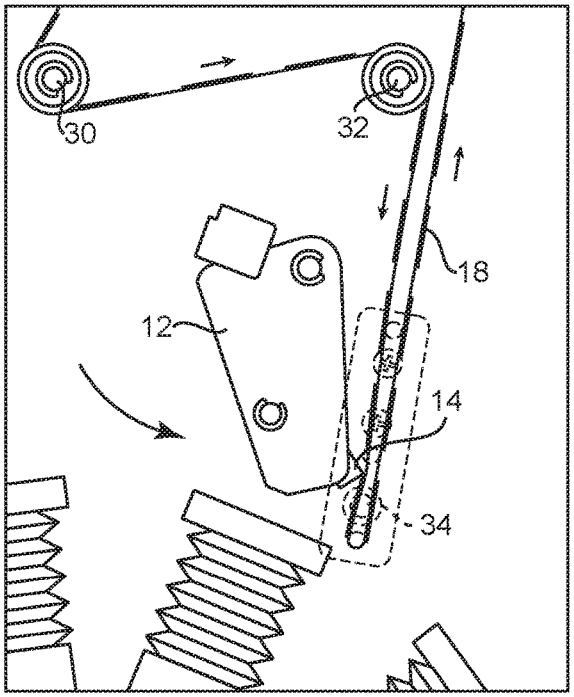
FIG. 2 is a schematic overview of the print head of a thermal printer and label path with the print head positioned against the label run during dispensing, according to an embodiment of the invention.

FIGS. 1 and 2 schematically show the print head assembly 12 having the print head 14 within a thermal printer. The label run 16 includes a plurality of labels 18 spaced thereon. The label run passes around various directional spindles 30, 32, 34, etc. to be guided through the printer across the print head 14 when the print head assembly is engaged (FIG. 2). As shown, as the labels 18 pass across the printhead heating elements 14 during printing or dispensing. As such, the abrasive action or the friction of the labels 18 passing over the printhead heating elements 14 results in damage and wear to the same. Thus, when using the thermal printer for label dispensing and not printing, it will become apparent that such action of running the labels through the printer and across the printhead heating elements 14 will ultimately result in increased wear of the printhead, and ultimately shorten the usable life of the same.

Figure 3:
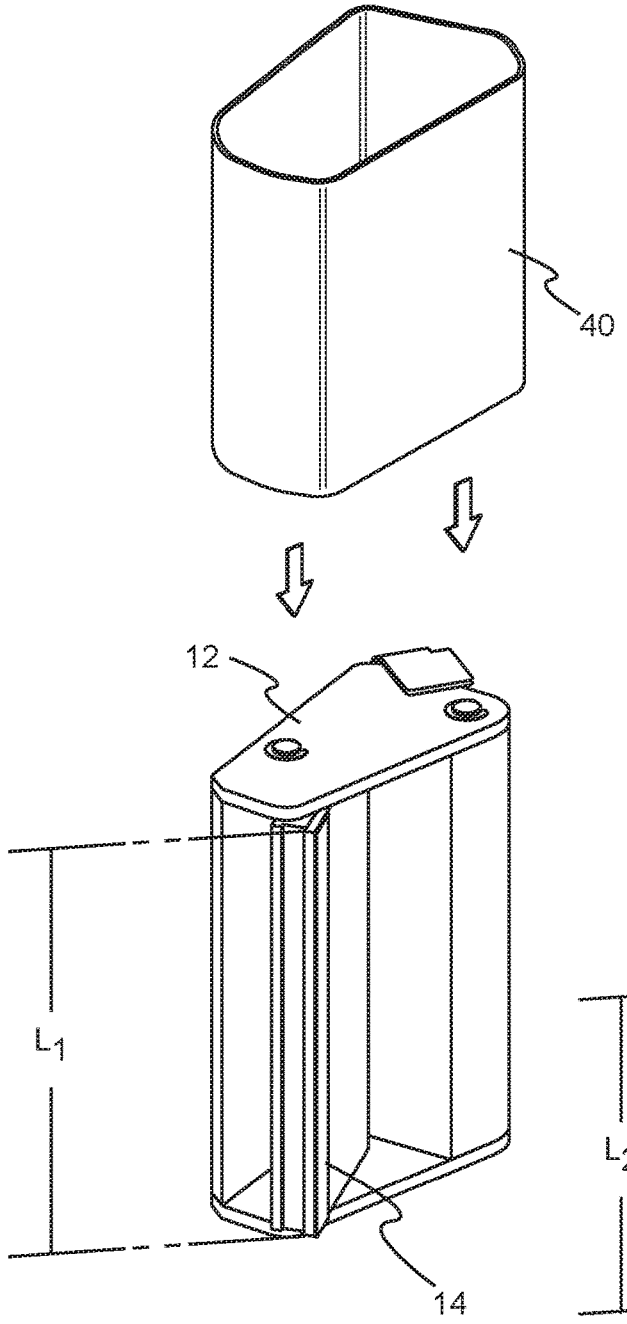
FIG. 3 is an exploded view of the print head with protective sleeve, according to an embodiment of the invention.
Figure 4:
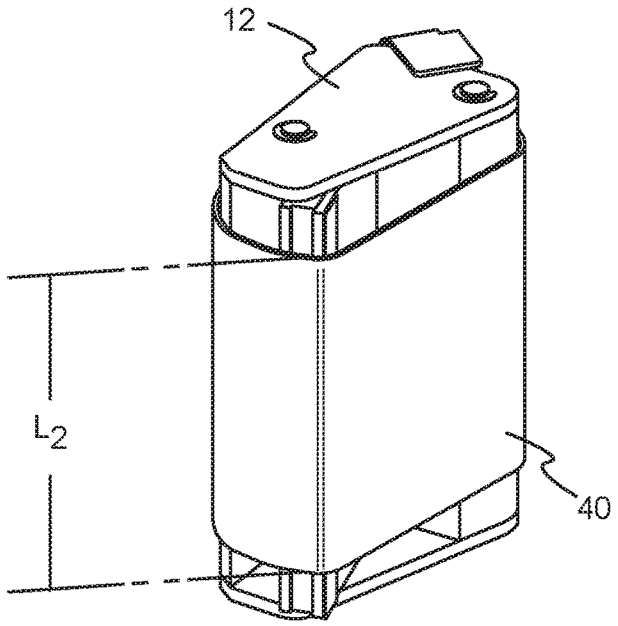
FIG. 4 is a plan view of the print head with the protective sleeve in place, according to an embodiment of the invention.

FIG. 3 shows the printhead assembly 12 (removed from the printer for ease of description) and a protective sleeve 40 according to an embodiment of the present invention. As shown in FIG. 4, the sleeve 40 fits over the printhead assembly 12 as shown. Generally speaking, the printhead 14 will have a length or size L1 which essentially dictates the size of the printing area of the same.

Figure 5:
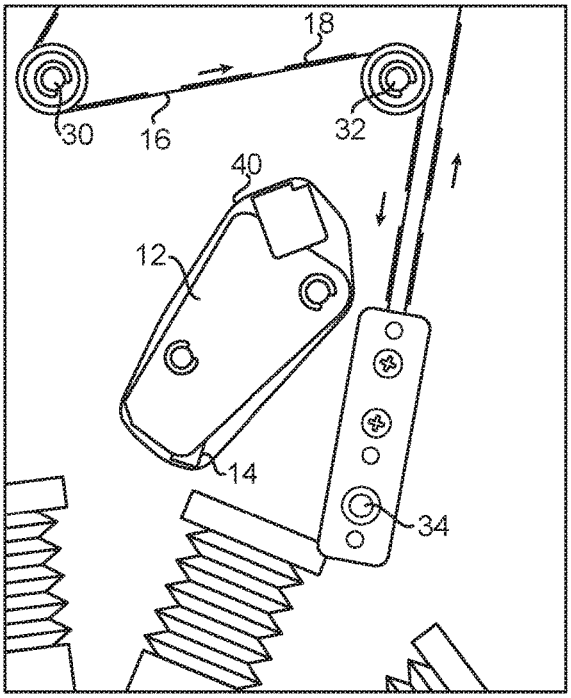
FIG. 5 is a schematic overview of the print head of a thermal printer with the protective sleeve in place while the print head is positioned away from the label run, according to an embodiment of the invention.
Figure 6:
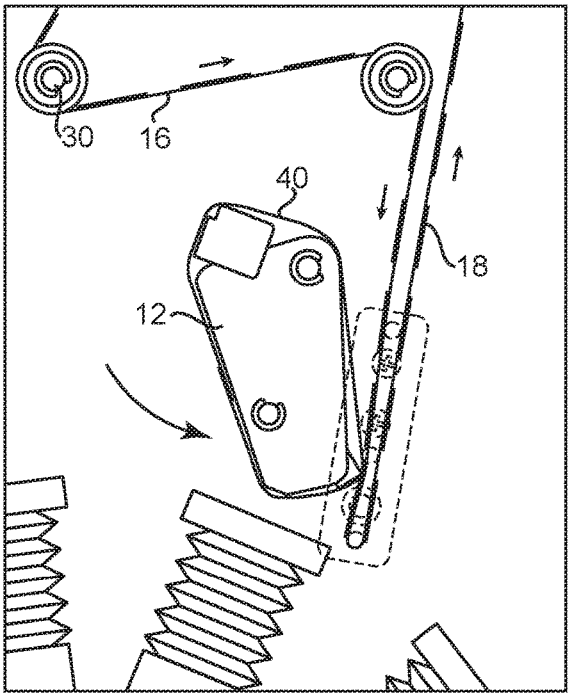
FIG. 6 is a schematic overview of the print head of a thermal printer with the protective sleeve in place and label path with the protected print head positioned against the label run during dispensing, according to an embodiment of the invention.

FIG. 5 shows the printhead assembly 12 with the protective sleeve 40 positioned thereon and before the printhead assembly 12 is engaged for label printing or dispensing. FIG. 6 shows the printhead assembly 12 with the protective sleeve 40 engaged for label printing or dispensing. As shown, now, as the labels 18 move through the printer, the printhead heating elements 14 is protected from the abrasive action caused by the labels moving across the same. When dispensing is completed, the protective sleeve 40 can be removed and the printer used for printing as usual.

In accordance with one embodiment, the coefficient of friction of the protective sleeve is very low. Those of skill in the art will appreciate that the coefficient of friction for different materials can be drastically different. As such, and as a guideline, the coefficient of friction for most materials is between 0 and 1, with 0 being the lowest (i.e., no friction). According to the present principles, the printhead cover or sleeve has a low coefficient of friction, preferably 0.3 or less.

In accordance with one exemplary embodiment, the protective sleeve 40 is made of an ultra-high molecular weight flexible tape (UHMW) having a coefficient of friction in a range of 0.10-0.20, and has a length or size L2 that does not necessarily have to equal the length or size L1 of the printhead 14. In fact, the length or size L2 can be dictated by the size or width of the label run (thermal material) 16 that would be passing over the printhead heating elements 14. Thus, L2 will generally be less than L1 in this instance, but L2 must always be larger than the width of the label run or thermal material 16.

In accordance with other contemplated embodiments, the protective sleeve 40 can be replaced with other devices that operate in the same manner to shield the printhead heating elements 14 from the abrasive action caused by the labels moving across the same.

Examples of such other embodiments include a clip-on cover that clips onto the printhead 14 or the assembly 12. In this embodiment, it is envisioned that the clips would engage another portion of the printhead assembly 12 such that a thin strip of material covers the printhead heating elements 14. Another embodiment would include a strip having a removable adhesive that covers the print elements of the print head 14. This strip could be disposable and be a single use type of product. According to yet another embodiment, the printer could be modified to allow the roller assembly 34 which applies pressure on the back of the thermal material (i.e., label run 16) to be retracted away from the printhead 14 such that the thermal material 16 does not come into contact with the same when operating the printer as a label dispenser.

Figure 7:
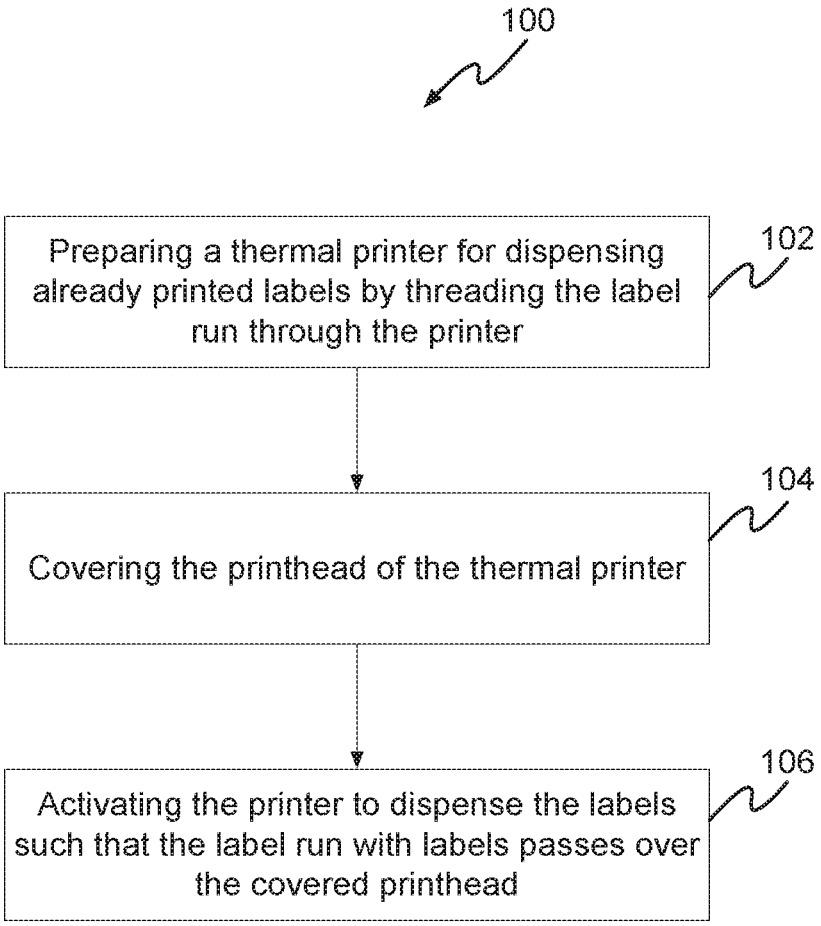
FIG. 7 is a flow chart of the method for protecting/covering the printhead heating elements in a thermal printer, according to an embodiment of the invention.

In accordance with other embodiment shown in FIG. 7, a method 100 for protecting the printhead heating elements of a thermal printer is provided. The method includes preparing the thermal printer for dispensing already printed labels (thermal material)—102. Once prepared, the printhead is covered with a thin material having a low coefficient of friction—104. Once covered, the printer is engaged or activated to dispense the labels—106, and the thermal material or label run is run through the printer and over the covered printhead heating elements such that the printhead heating elements is no longer exposed to the abrasive action causes by the thermal material passing over the same.

Figure 8:
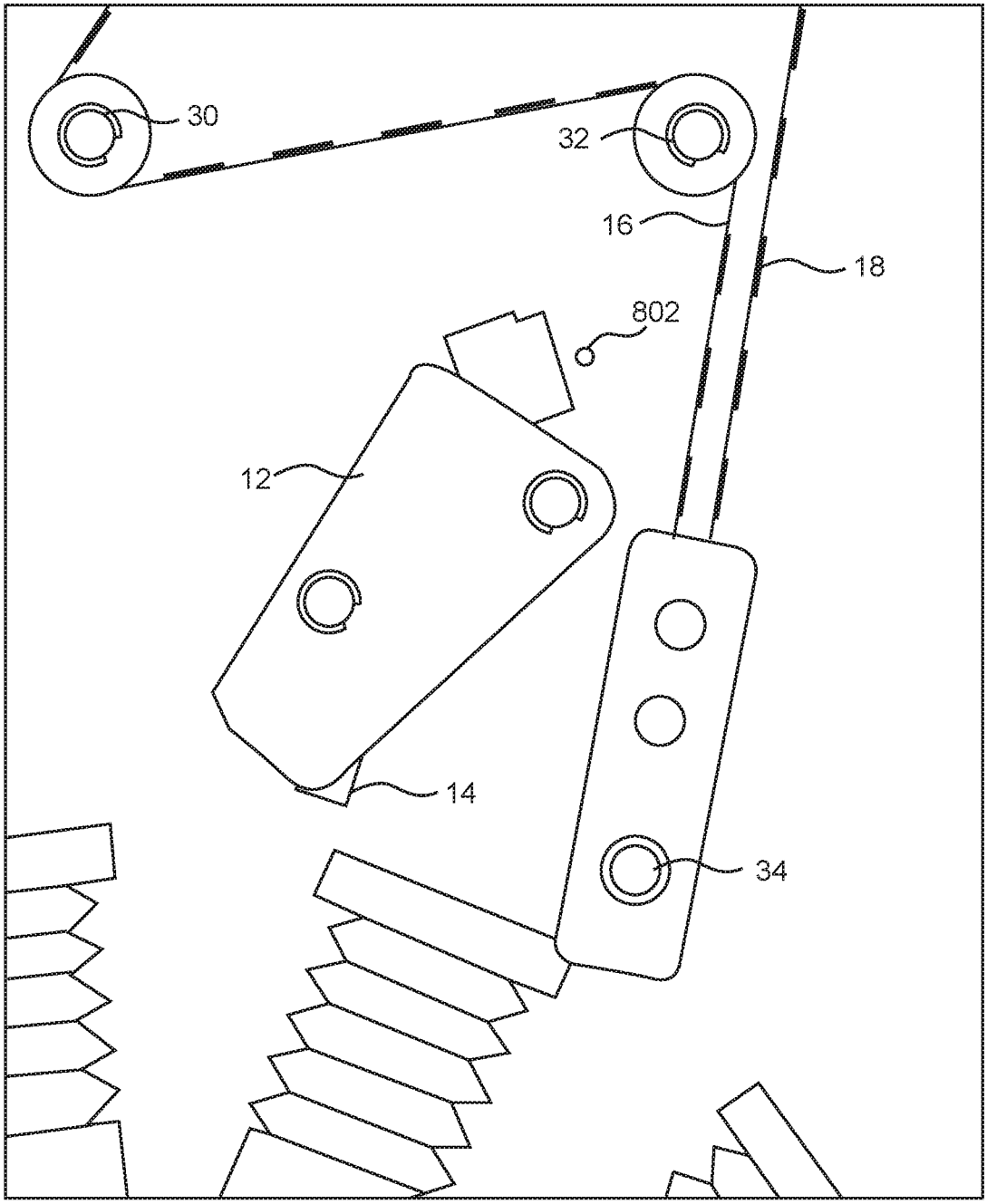
FIG. 8 is a schematic overview of the print head of a thermal printer and label path with the print head positioned away from the label run, according to an embodiment of the invention.
Figure 9:
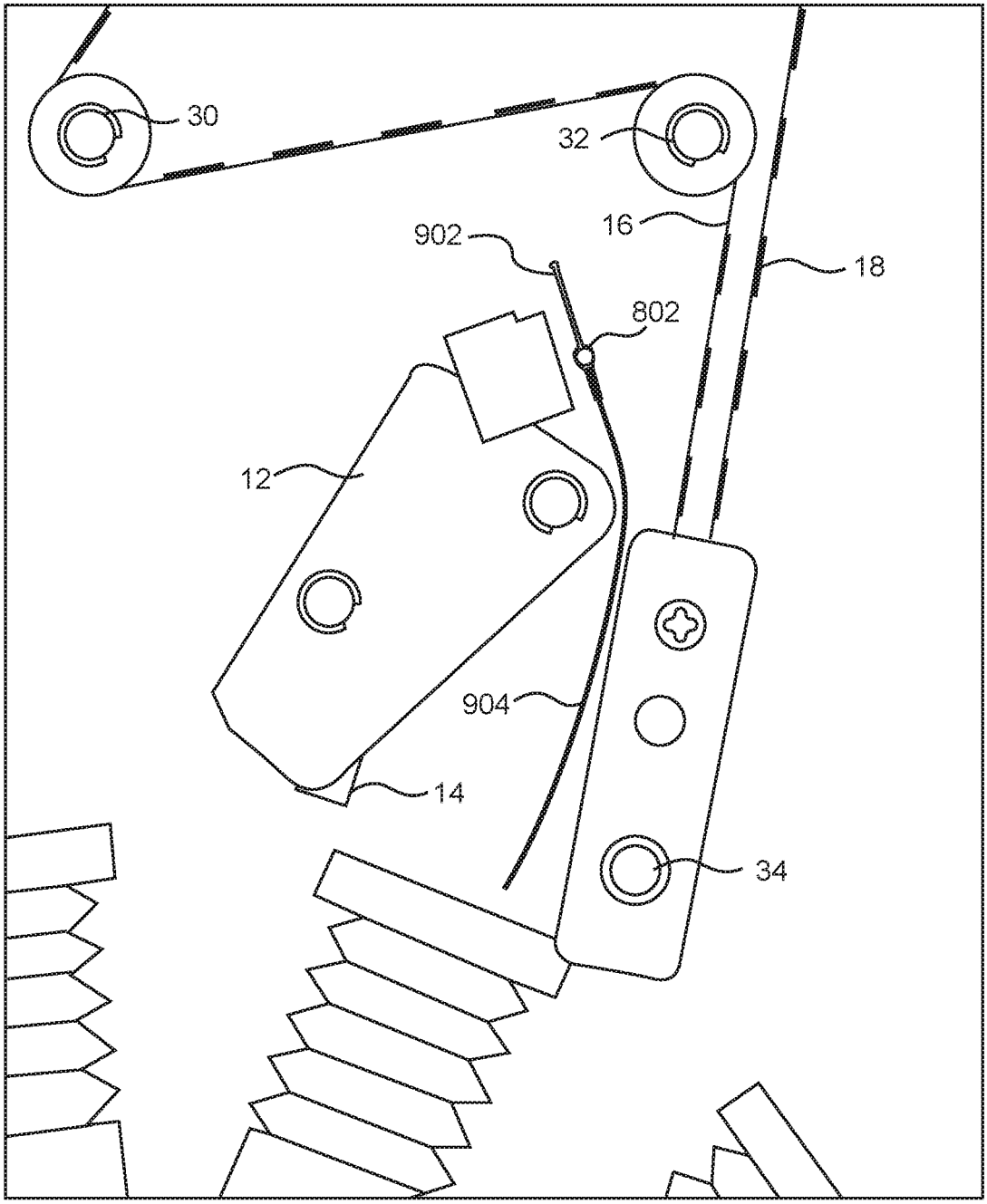
FIG. 9 is a schematic view of the print head of a thermal printer and label path with a protective shim mounted on the thermal printer, according to an embodiment of the invention.
Figure 10:
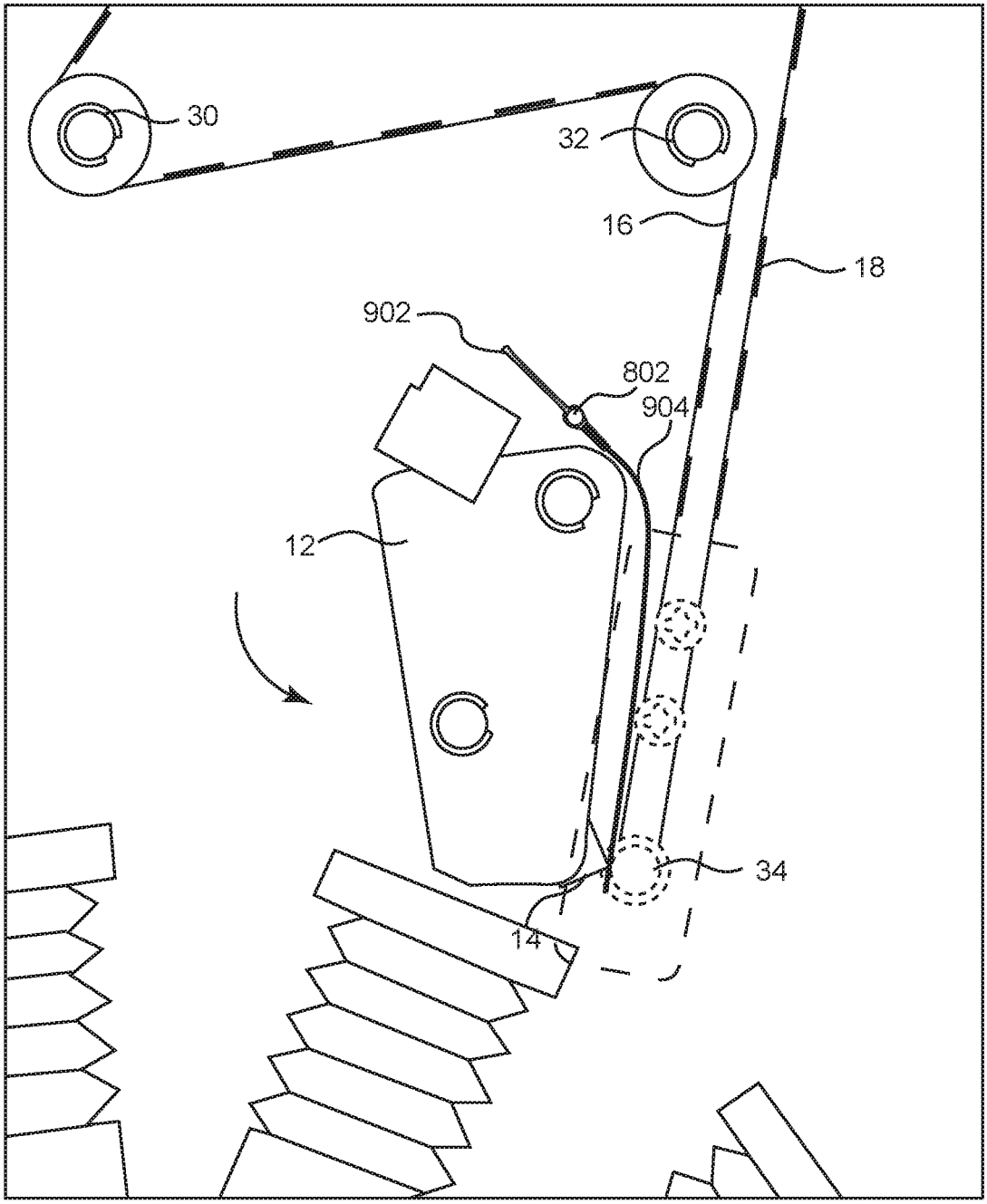
FIG. 10 is a schematic view of the print head of a thermal printer and label path with the protective shim mounted on the thermal printer and the print head positioned against the label run during dispensing, according to an embodiment of the invention.
Figure 11A:
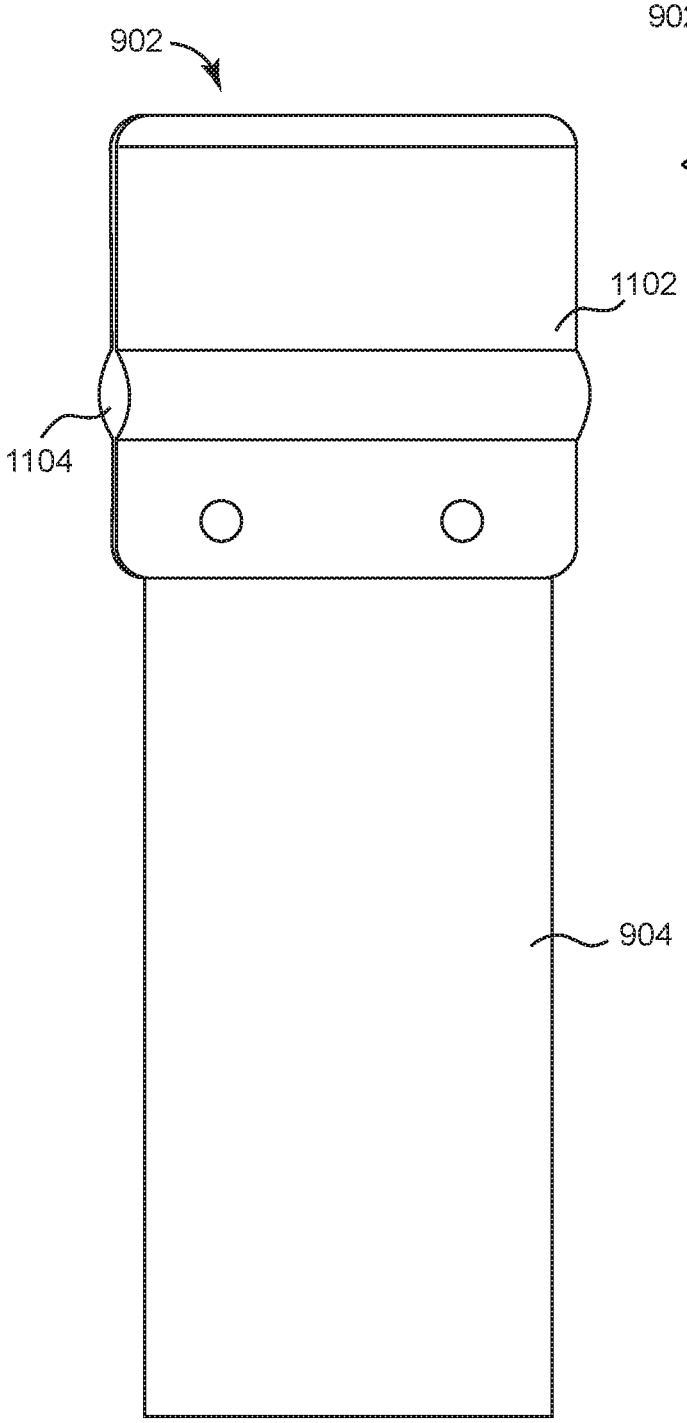
FIG. 11A is a schematic view of the protective shim of FIG. 9.
Figure 11B:
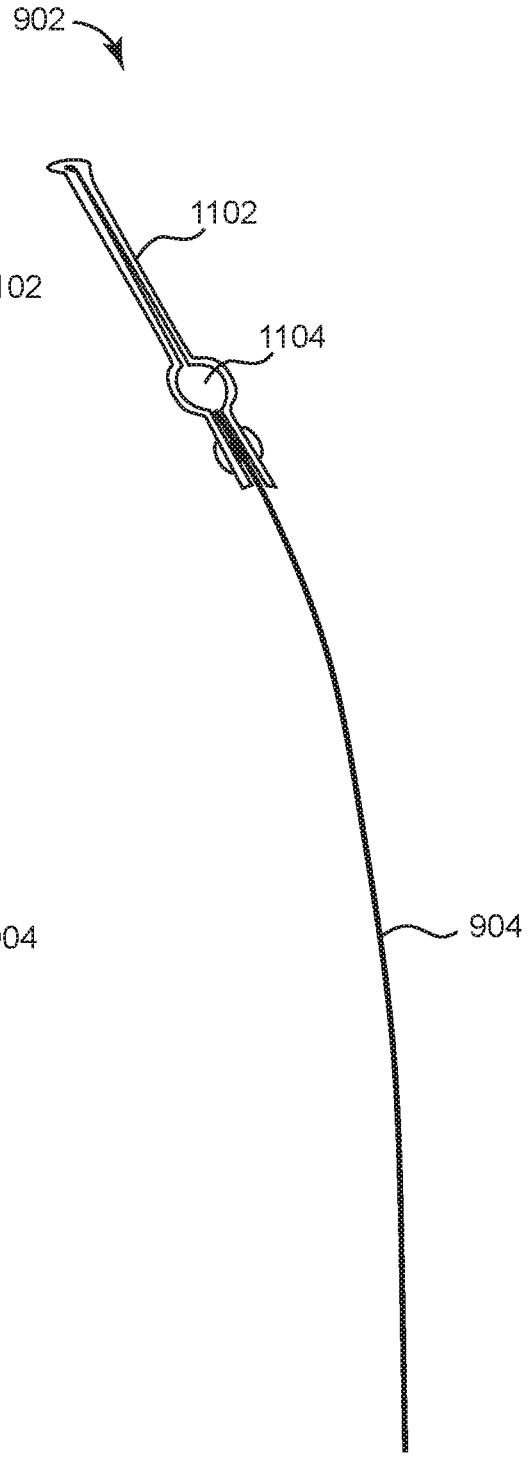
FIG. 11B is a side view of the protective shim shown in FIG. 11A.

Turning to FIG. 8-11, another embodiment is shown in which the thermal printhead heating elements 14 is protected during label dispensing using a removable shim shown in FIGS. 11A and 11B. The embodiment of FIG. 8 is a modification of the thermal printer shown in FIG. 1 in which a mounting peg 802 is affixed to a surface of the thermal printer near the printhead assembly 12. The mounting support 802 can be provided on the thermal printer at the time of manufacture of the thermal printer. In other embodiments, the mounting support 802 can take the form of a peg or a rod that is permanently or removably secured onto the thermal printer using any suitable known means. In still other embodiments, the mounting support 802 can be affixed to the thermal printer using an appropriate welding technique, or even an epoxy.

FIG. 9 shows the protective shim assembly 902 mounted on the thermal printer in accordance with one embodiment. The protective shim assembly 902 receives the mounting support 802 such that the protective shim assembly 902 can rotate or pivot about an axis of the mounting support 802. In accordance with an embodiment, the shim assembly 902 includes an ultra-high molecular weight (UHMW) flexible plastic shim 904 having a coefficient of friction, in a range of 0.10-0.20, and preferably less than 0.30. When mounted on the mounting support 802, the shim assembly 902 positions the plastic shim 904 between the printhead assembly 12 and the roller assembly 34. As shown in FIG. 10, when the printhead assembly 12 is positioned against the roller assembly 34 during use of the printer for label dispensing, the plastic shim extends along the printhead heating elements assembly 12 to a point that terminates beyond the printhead heating elements 14. The width and length of the plastic shim 904 are dimensioned to cover the active surface of the printhead heating elements 14 and prevent the same from contacting the label run 16.

FIGS. 11A and 11B shows a schematic of the structure of the shim assembly 902. The shim assembly 902 includes a holder 1102 to which the plastic shim 904 is affixed. The plastic shim 904 can be attached to the holder 1102 using crimping, adhesive, rivets, bolts or other suitable attachment devices and methods. The holder 1102 can be formed of steel, aluminum, copper or other metals or alloys having appropriate rigidity. Alternatively, the holder 1102 can be formed from a plastic material, such polylactic acid (PLA) Acrylonitrile Butadiene Styrene (ABS), polyamides, polyethylene (e.g., UHMW polyethylene), for example.

The shim assembly 902 is formed with a mounting device such as a through hole 1104, for example, formed on/in the holder 1102. The through hole 1104 is dimensioned to receive the mounting support 802 shown in FIG. 8. Moreover, the through hole 1104 is so dimensioned so as to allow free rotation of the shim assembly 902 about the mounting support 802. Since little lateral force is experienced by the shim assembly 902, a retaining device for holding the shim assembly 902 on the mounting support 802 should not be necessary. However, in some embodiments the mounting support 802 can be configured to accept a retaining ring (e.g., E-style retaining ring) or cotter pin as a retaining device.

While FIG. 11 shows the shim assembly as a two piece structure having a holder 1102 that is separately formed from the plastic shim 904, in some embodiments, the shim assembly 902 can be formed as a unitary body in which the holder 1102 and the plastic shim 904 are formed of a single unitary plastic material.

In another embodiment, rather than mount the shim assembly 902 onto the mounting support 802, the shim assembly 902 can include one or more magnets having sufficient strength to hold the shim assembly 902 onto a ferromagnetic material surface of the printhead assembly 12 as mounting devices. In this embodiment, the holder 1102 does not have the through hole 1104 formed thereon. Instead, the holder 1102 can be made of a ferromagnetic material, such as steel or its alloys, for example. The holder 1102 in the present embodiment can be magnetized. Alternatively, the holder 1102 can be fabricated from a plastic with one or more magnets embedded thereon.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A device for protecting a printhead of a thermal printer, comprising:

a shim assembly including:

a holder having a mounting device configured to affix the shim assembly to the thermal printer proximate to a printhead assembly, and a shim held by the holder and dimensioned to extend from a mounting point of the mounting device to a point such that the shim is positioned between an active surface of a printhead heating elements of the printhead assembly and a label run to prevent the printhead heating elements from being able to contact the label run as the same is being dispensed by the thermal printer.

2. The device of claim 1, wherein the mounting device comprises a through hole formed on the holder portion and dimensioned to receive a mounting support affixed to a surface of the thermal printer.

3. The device of claim 1, wherein the mounting device comprises one or more magnets disposed on the holder and positioned to magnetically hold the shim assembly to a ferromagnetic material surface of the printhead assembly.

4. The device of claim 1, wherein the shim has a coefficient of friction less than 0.3.

5. The device of claim 1, wherein the holder is fabricated from a metal, and the shim is fabricated from a plastic material.

6. The device of claim 1, wherein the holder and the shim are formed as a unitary body and fabricated from a plastic material.

7. The device of claim 1, wherein the shim comprises an ultra-high molecular weight flexible polyethylene.

* * * * *